United States Patent [19]

Dampney et al.

[11] Patent Number: 4,907,300

[45] Date of Patent: Mar. 13, 1990

[54] HELMET AND VISOR MECHANISM THEREFOR

[75] Inventors: Ian T. Dampney, London; Michael Good, Luton, both of England

[73] Assignee: Helmets Limited, St. Albans, United Kingdom

[21] Appl. No.: 128,108

[22] Filed: Dec. 3, 1987

[30] Foreign Application Priority Data

Dec. 3, 1986 [GB] United Kingdom ..... 8628864

[51] Int. Cl.[4] ..... A42B 3/02

[52] U.S. Cl. ..... 2/424; 2/6

[58] Field of Search ..... 2/6, 423, 424, 425, 2/427, 428, 429

[56] References Cited

U.S. PATENT DOCUMENTS

| | | | |
|---|---|---|---|
| 3,593,338 | 7/1971 | Penny | 2/427 |
| 4,199,823 | 4/1980 | Jenkins et al. | 2/424 |
| 4,292,688 | 10/1981 | Ellis | 2/6 |
| 4,621,377 | 11/1986 | Pennell | 2/6 |

FOREIGN PATENT DOCUMENTS

| | | | |
|---|---|---|---|
| 3015082 | 9/1981 | Fed. Rep. of Germany | 2/425 |
| 2413892 | 8/1979 | France . | |
| 2434251 | 12/1980 | France . | |
| 1446416 | 6/1986 | France . | |
| 1561660 | 2/1980 | United Kingdom . | |

*Primary Examiner*—Wm. Carter Reynolds

*Attorney, Agent, or Firm*—Birch, Stewart, Kolasch & Birch

[57] ABSTRACT

A helmet with twin visors movable between raised and lowered positions has a locking mechanism for each visor which automatically locks the visor in the raised or lowered position. An operating lever for each visor can be operated with one hand by the wearer, a single movement of the lever first releasing the locking mechanism and then moving the visor from one to the other of its raised and lowered positions. Each locking mechanism may comprise a cam plate fixed to the helmet shell and two pawls carried by the visor arm and spring-biased to engage the cam to lock the visor in the raised or lowered position respectively. The operating lever engages the appropriate pawl to disengage it from the cam plate and rotate the visor arm, on movement of the lever in the appropriate direction. The lower position of each visor may be adjustable, for example to accommodate an oxygen mask fitted to the helmet. The mechanism may also be used on a helmet fitted with a single visor.

10 Claims, 7 Drawing Sheets

HELMET AND VISOR MECHANISM THEREFOR

This invention relates to helmets.

The invention relates more particularly to visor mechanism assemblies for helmets.

Helmets, such as aircrew helmets, are fitted with one, or usually two, visors, to provide facial protection against the effects of (1) wind blast (2) bird-strike debris and to provide protection against sun-glare. There is a need for a helmet with a visor mechanism which enables the visor to be moved easily from the raised position to the operative position, which locks it securely in the raised operative positions while providing intermediate frictional positioning and which is relatively unobtrusive. It is also desirable, in a twin-visor helmet, for each visor to be movable between its raised and operative positions.

SUMMARY OF THE INVENTION

This invention consists of a helmet provided with a visor movable between a raised position and a lowered position, a releasable locking mechanism operable automatically to lock the visor in position on movement of the visor to the raised or the lowered position, and an operating lever positioned on the helmet so that it can be operated by the wearer using one hand and being movable between first and second positions, the lever being connected to the visor so that movement of the lever between its first and second positions moves the visor between its raised and lowered position, in which the operating lever is adapted to engage the locking mechanism to release the lock during an initial part of the movement of the lever from its first or its second position to allow movement of the visor.

In one form of the invention, the helmet is provided with twin visors, for example an outer sun visor for protection against radiation and an inner blast visor, the visors are movable independently between raised and lowered positions, and a separate operating lever and locking mechanism are provided for each visor. The two operating levers may be provided on the same side or opposite sides of the helmet.

Preferably, one or both of the locking mechanisms comprises a cam member fixed to the helmet visor pivot and two pawls mounted on the visor arm, each pawl being resiliently biased to a position in which it engages a surface of the cam plate to lock the visor in the raised or lowered position respectively, the operating lever being arranged to engage the appropriate pawl and move it out of engagement with the cam plate during the initial part of the movement of the lever.

The cam plate may be arranged to provide two alternative lower positions of the visor, for example to allow for an aircrew helmet worn with or without an oxygen mask.

In one embodiment of the invention, the pawls of one or both of the locking mechanisms are carried on a supporting arm of the associated visor, the cam plate being fixed to the helmet, and the operating lever is arranged to remain in engagement with the appropriate pawl after moving it out of engagement with the cam plate, the force acting on the lever being transmitted through the pawl to the visor arm to move the visor arm from one position to the other.

Suitably, one or both of the operating levers and the supporting arm of the associated visor are pivotally mounted on a common pivot.

The invention also includes a visor mechanism for a helmet as defined above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described, by way of example, with reference to the accompanying drawings which are given by way of illustration only, and thus, are not limitative of the present invention, and in which.

DETAILED DESCRIPTION OF THE PREFERRED EMBODIMENTS

Figure 1:
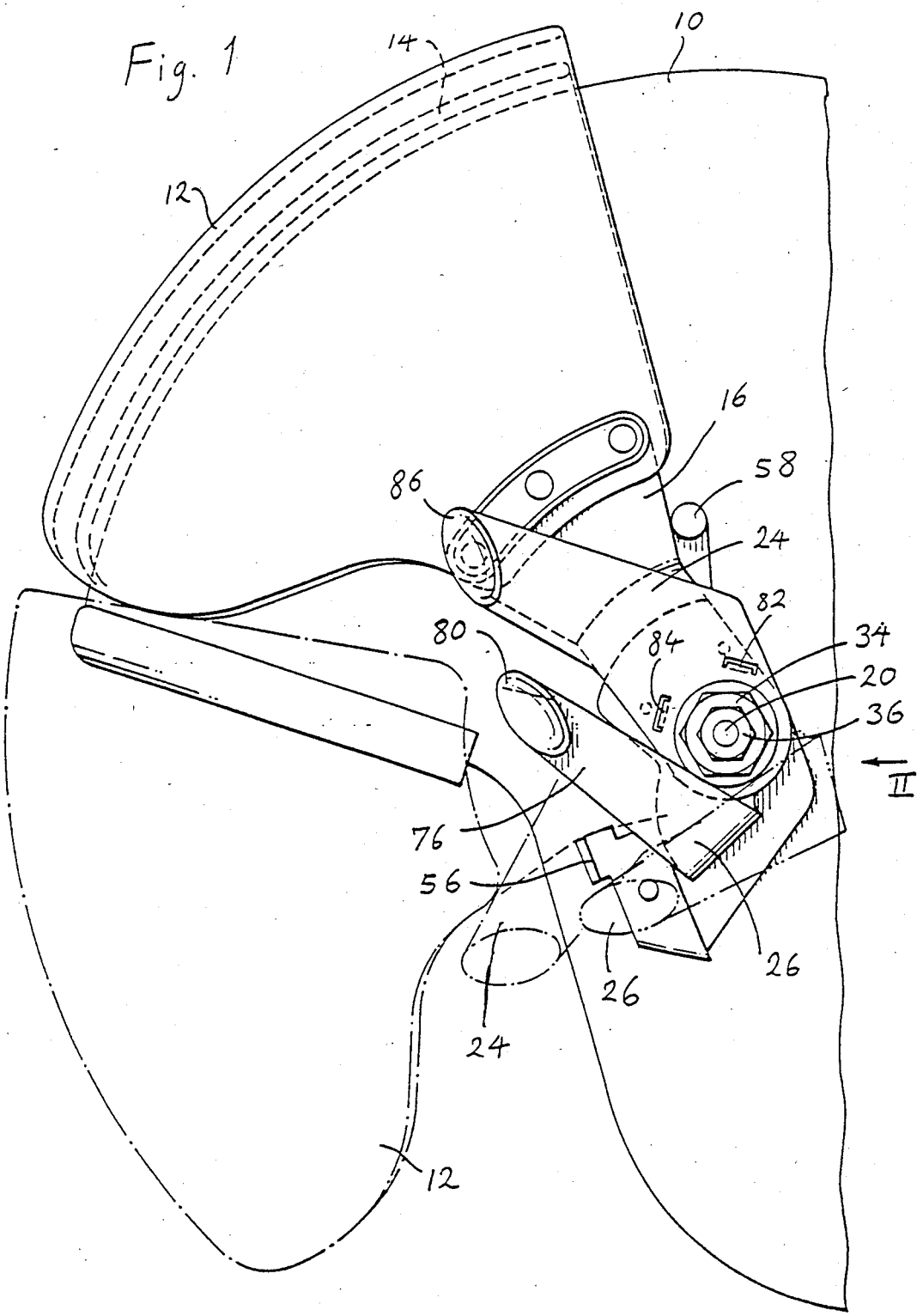
FIG. 1 is a side view of part of an aircrew helmet with twin visors.
Figure 2:
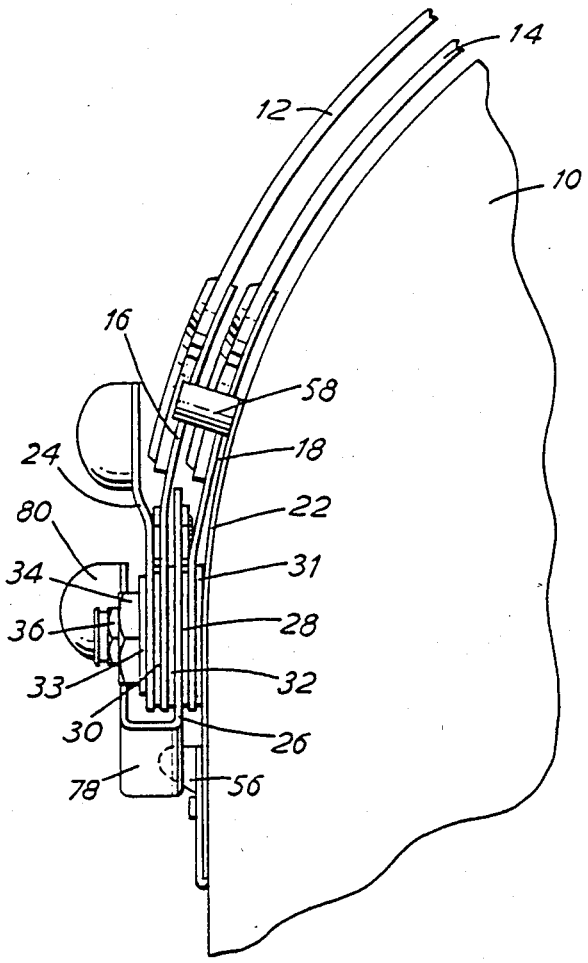
FIG. 2 is a fragmentary view looking in the direction of arrow II in FIG. 1.
Figure 4:
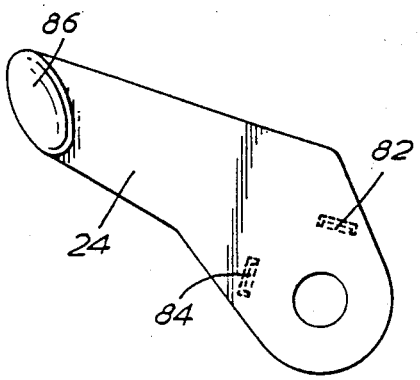
FIG. 4 shows a release lever for the outer visor.
Figure 5:
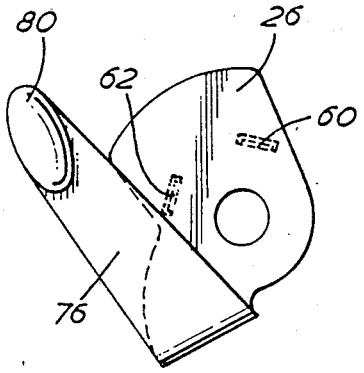
FIG. 5 shows a release lever for the inner visor.

Referring to FIGS. 1 to 7, a helmet 10 is provided with an outer sun visor 12 and an inner protective visor 14. The visors are pivoted to the helmet shell so that they can be moved independently between the raised positions, shown in solid lines in FIG. 1, and lowered positions, as shown in broken lines in FIG. 1. The outer visor 12 is carried by an arm 16 pivoted on the left side of the helmet and an arm (not shown) on the right side of the helmet. The inner visor 14 is similarly carried by an arm 18 on the left and an arm (not shown) on the right of the helmet. The arms 16 and 18 are pivoted on a pin 20 which is fixed to a plate 22 secured to the helmet shell to hold the pin against rotation. The plate 22 may be adjustable in position, to allow fine adjustment of the raised and lowered positions of the visor.

Also pivoted on the pin 20 are a release lever 24 for the outer visor 12 and a release lever 26 for the inner visor 14. Sandwiched between the arm 18 of the inner visor 14 and the inner release lever 26 is a cam plate 28, which fits on the pin 20 so as to be held against rotation. A similar cam plate 30 fits between the arm 16 of the outer visor 12 and the outer release lever 24. A friction washer 32 fits between the arm 16 and the inner release lever 26. A friction washer 31 similarly fits between the plate 22 and visor arm 18 and a friction washer 33 fits between the outer release lever 24 and a nut 34. The various components are held on the pin 20 by the nut 34 which engages a thread on the pin 20. The nut 34 is tightened to give the required frictional resistance to movement of the arms 16 and 18 and levers 24 and 26, and held in position by lock-nut 36. The frictional resistance provided by the friction washers 31, 32 and 33 enables either of the visors 12 and 14 to be held frictionally in intermediate positions between the raised and lowered positions.

The visor arms at the right side of the helmet 10 are pivotally mounted on a pin (not shown) in a similar fashion, but without the interposition of release levers and cam plates.

Figure 3:
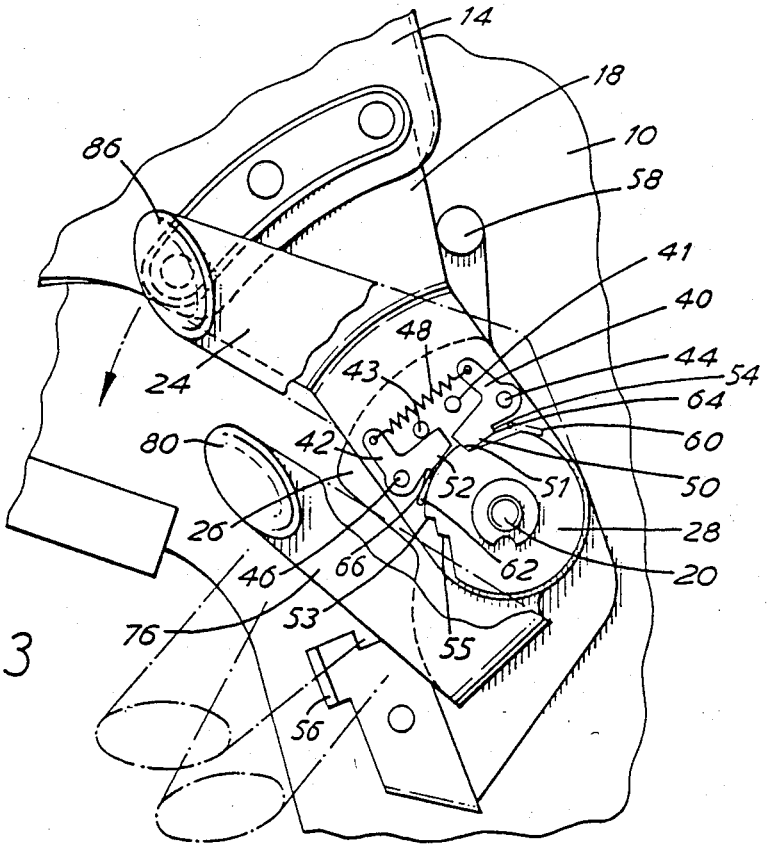
FIG. 3 is a fragmentary view similar to FIG. 1, but with part broken away to show the locking and release mechanism of the inner visor, with the inner visor in its upper position.
Figure 6:
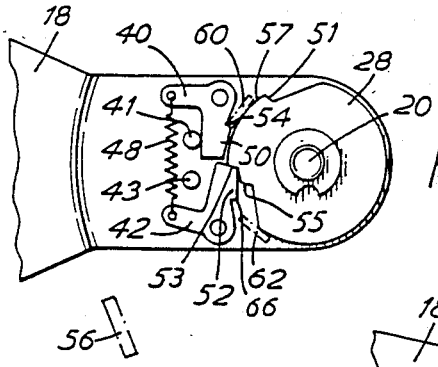
FIG. 6 is a fragmentary view of the locking mechanism of FIG. 3, with the visor in a lower position.
Figure 7:
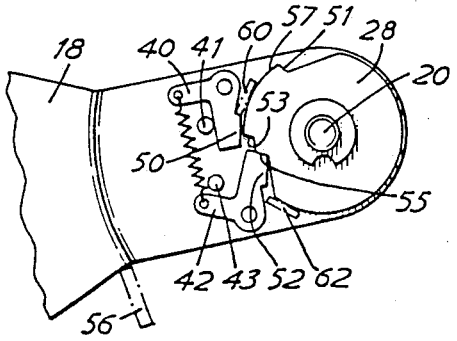
FIG. 7 is a view similar to FIG. 6, with the visor in an alternative lower position.

As shown in FIGS. 3, 6 and 7, the inner visor arm 18 carries two locking pawls 40 and 42, which are mounted on one face of the arm so as to engage the adjacent cam plate 28. The pawls are pivoted to the arm on pins 44 and 46 and are biased into engagement with the cam plate 28 by a tension spring 48 acting between lugs on the two pawls. The pawl 40 has a tooth 50 which, when the visor 14 is in the uppermost position, as shown in FIG. 3, engages a face 51 on the cam plate 28 to hold the visor arm 18 against rotation in the anticlockwise direction as seen in the drawings, i.e. against downward movement to lock the visor 14 in the uppermost position. The other pawl 42 has a tooth 52 which, when the visor 14 is in the lower position, as shown in FIG. 6, engages a face 53 on the cam plate 28 to hold the arm 18 against rotation in the clockwise direction, i.e. against upward movement, to lock the visor 14 in the lower position. The surface 57 of the cam plate 28 between the faces 51 and 53 is smoothly curved so that on movement of the visor to the upper or lower positions, the pawls 40 and 42 ride over the surface 57 with the appropriate pawl dropping into its locking position as the visor reaches the end of its movement.

The lower position of the visor 14 defined by engagement of the pawl 42 with the face 53 of the cam plate 28 is appropriate when the helmet 10 is used with an oxygen mask. When the helmet is used without a mask, the visor 14 can be moved to a somewhat lower position. To allow the visor to be locked in this position, the cam plate 28 has a further face 55 which is engaged by the pawl 42 when the visor is in the further lower position, as shown in FIG. 7. A stop 56 fixed to the helmet shell prevents movement of the visor arm 18, and of the outer visor arm 16, beyond the second lower position. A stop 58 similarly prevents upward movement of the outer and inner visors 12 and 14 beyond the uppermost position.

The inner release lever 26 is formed with two lugs 60 and 62, which project towards the visor arm 18. The lug 60 is positioned so that, as the release lever 26 is rotated in an anti-clockwise direction from the upper position shown in FIG. 3, the lug 60 engages the pawl 40 so as to rotate it out of engagement with the face 51 of the cam plate 28. At the same time the lug 60 engages a face 54 of the tooth 50 so that on further rotation of the lever 26, the pawl 40 and the arm 18 are rotated with the lever 26. The lug 62 is positioned so that, as the release lever 26 is rotated in a clockwise direction from the lower position shown in FIG. 6, the lug 62 engages the pawl 42 so as to rotate it out of engagement with the face 53 of the cam plate 28. The lug 62 engages a face 66 of the pawl 52, so that further clockwise rotation of the lever 26 causes rotation of the arm 18. Similarly, rotation of the lever 26 when the arm 18 is in the second lower position shown in FIG. 7, will cause the lug 62 to engage the pawl 42 and move it out of engagement with the face 55 on cam plate 28 and rotate the arm 18. Stops 41 and 43 on the arm 18 limit the rotation of the pawls 40 and 42 by the lugs 60 and 62.

The inner release lever 26 has an outer arm 76 joined to the main part of the lever by an intermediate portion 78 so that the arm 76 lies outside the outer release lever 24, to enable the two levers 24 and 26 to be moved independently without interfering with one another. At its forward end the arm 76 has a knob 80 by means of which the release lever 26 can be easily grasped by the left hand of the wearer to rotate the lever 26 to move the inner visor 14 between its upper and lower positions.

The outer visor arm 16 is similarly provided with pawls (not shown) spring-biased into engagement with the cam plate 30, and the outer release lever 24 has two lugs 82 and 84 arranged to engage the pawls. This locking mechanism operates in the same way as the locking mechanism for the inner visor, and will therefore not be described further. The outer release lever 24 has a knob 86 to enable the lever to be easily operated.

The described mechanism enables either of the visors to be moved from its raised to its lowered position or vice versa, with a single movement of the operating lever and ensures that the visor is automatically locked in each position. The mechanism is compact, and therefore, does not project undesirably from the side of the helmet.

FIGS. 8 to 13 show a second embodiment of the invention, which differs from the first embodiment in that the operating levers and locking mechanisms for the inner and outer visors are positioned on opposite sides of the helmet, and in that different mechanisms are provided for allowing for the two lower positions of the visors and for preventing over rotation of the visors in the rearward direction.

Referring to FIGS. 8 to 13, the helmet 100 is provided with an outer tinted visor 112 and an inner clear visor 114. The visors are pivoted to the helmet shell so that they can be moved independently between raised positions, shown in FIGS. 8 and 9, and lowered positions, shown in broken lines in FIG. 8. The outer visor 112 is carried by an arm 116 pivoted on the right side of the helmet and an arm 216 on the left side of the helmet. The inner visor 114 is similarly carried by an arm 118 on the right and an arm 218 on the left side of the helmet.

The arms 116 and 118 are pivoted on a pillar 120 which is fixed to a base plate 122. The pillar 120 and base plate 122 are secured to the helmet shell by a threaded stud 121 which passes through a central bore in the pillar 120 and through a bore in the helmet shell and is retained by a lock nut (not shown) positioned on the inside of the helmet shell and engaging the end of the stud. The base plate 122 can itself pivot on the stud 121 through a limited angle, defined by the engagement of a screw 125 with the ends of a slot 123 in the base plate 122. The screw 125 engages a threaded bore in the helmet shell and can be tightened to fix the base plate in the desired orientation. This adjustability of the base plate 122 enables the lower position of the inner visor 114 to be adjusted, as described below.

Also pivoted on the pillar 120 is a release lever 126 for the inner visor 114. Sandwiched between the arm 118 of the inner visor 114 and the release lever 126 is a cam plate 128. The central aperture in the cam plate has two lugs 129 which engage in key slots in the pillar 120, so that the cam plate 128 is held against rotation relative to the pillar 120 and base plate 122. Friction washers 131, 132 and 133 fit between the base plate 122 and the inner visor arm 118, between the release lever 126 and the outer visor arm 116 and between the arm 116 and a friction adjustment nut 134. Nut 134 is adjusted so that the visors 112 and 114 can be easily rotated, but held by friction in any intermediate position. A lock nut 135 retains the components on the pillar 120.

Figure 9:
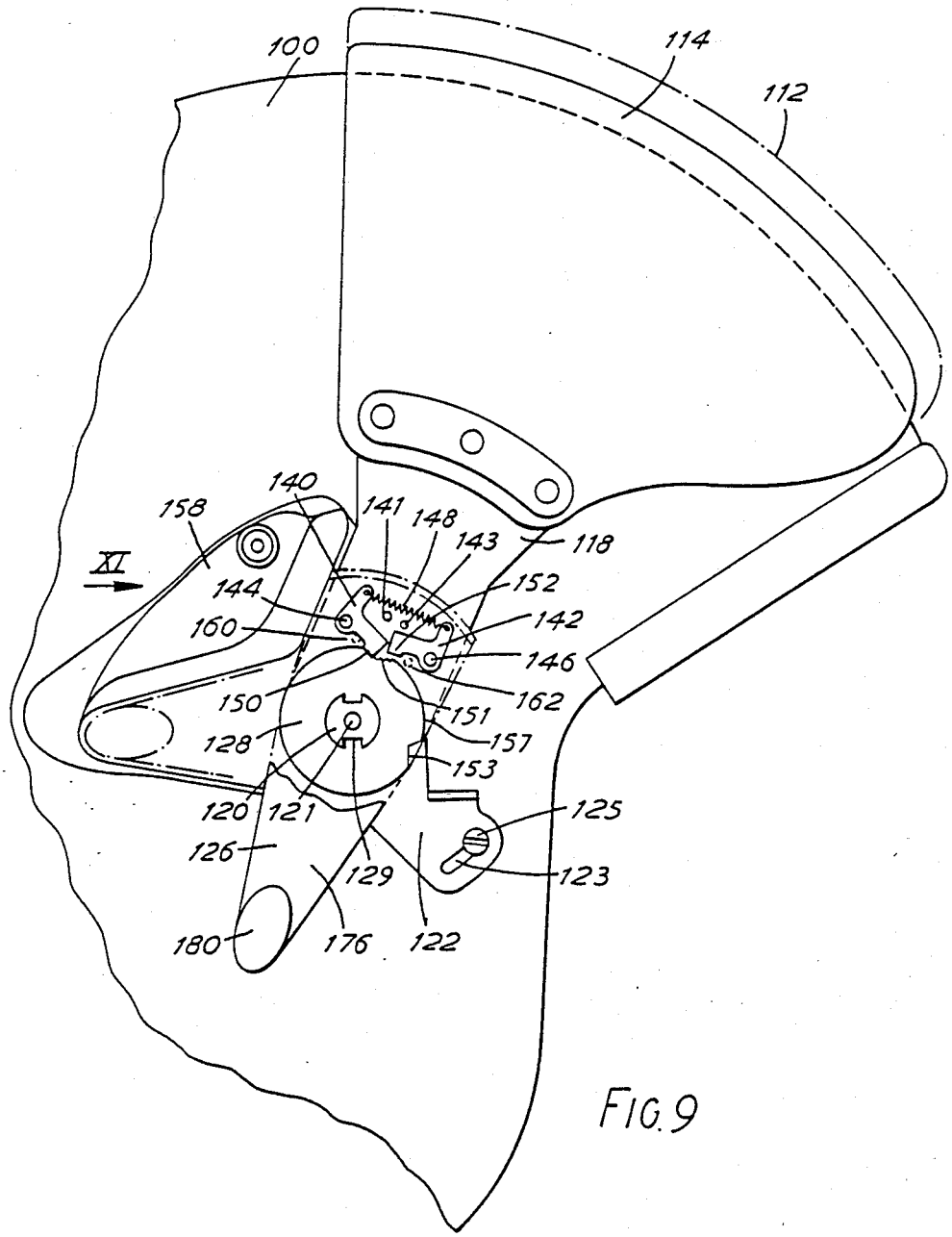
FIG. 9 is a right side view of the helmet of FIG. 8, with part broken away to show the visor locking mechanism.
Figure 10:
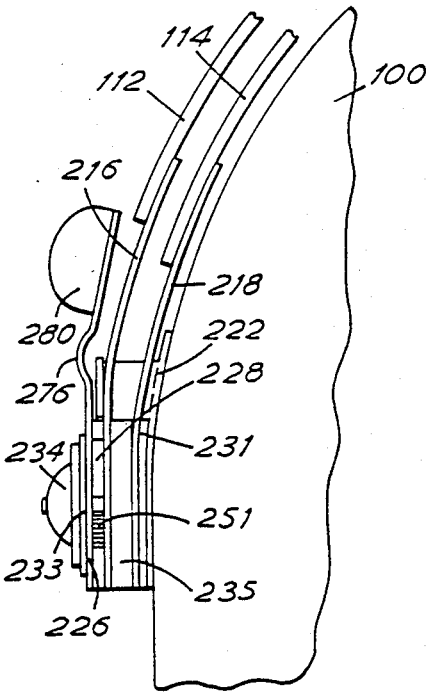
FIG. 10 is a fragmentary view in the direction of arrow X—X in FIG. 8, with a visor stop omitted for clarity.
Figure 11:
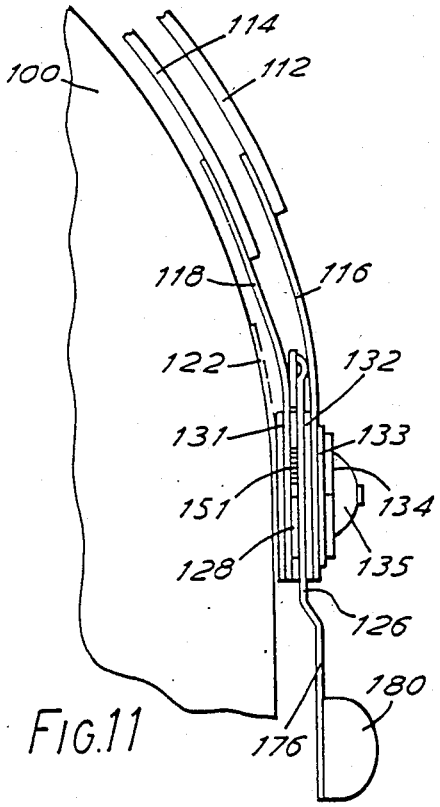
FIG. 11 is a fragmentary view in the direction of arrow XI—XI in FIG. 9, with a visor stop omitted for clarity.
Figure 12:
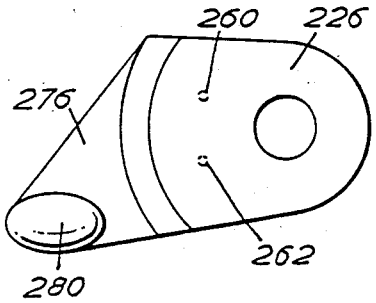
FIG. 12 shows a release lever for the inner visor.
Figure 13:
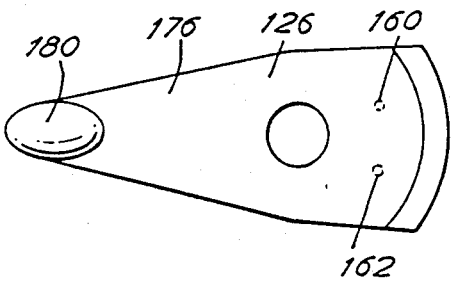
FIG. 13 shows a release lever for the outer visor of the second embodiment and FIG. 14 shows a modification of the embodiment of FIGS. 8 to 13 in which the visor stops are replaced by a rigid visor cover.

As shown in FIG. 9, the visor arm 118 carries two locking pawls 140 and 142, which are mounted on one face of the arm 118 so as to engage the periphery of the cam plate 128. The pawls 140 and 142 are pivoted to the arm on pins 144 and 146 and are biased into engagement with the cam plate 128 by a tension spring 148 acting between lugs on the two pawls. The pawl 140 has a tooth 150 which, when the inner visor 114 is in the uppermost position, as shown in FIG. 9, engages in one of a series of teeth 151 on the cam plate 128, to hold the visor arm 118 against rotation in the clockwise direction as seen in FIG. 9, to lock the visor 114 in the uppermost position. The other pawl 142 has a tooth 152 which, when the visor 114 is in the lower position, engages a face 153 on the cam plate 128, to hold the arm 118 against rotation in the anticlockwise direction, to lock the visor 114 in the lower position. The peripheral surface 157 of the cam plate 128 between the teeth 151 and the face 153 is smoothly curved so that on movement of the visor 114 to the upper or lower positions the pawls 140 and 142 ride over the surface 157 with the appropriate pawl dropping into its locking position as the visor reaches the end of its movement.

The lower position of the visor 114 defined by engagement of the pawl 142 with the face 153 of cam plate 128 can be adjusted by loosening the screw 125 and turning the base plate 122. As in the previous embodiment, this allows the visor, when the helmet is used without an oxygen mask, to be moved to a somewhat lower position than is appropriate when the helmet is used with a mask. The series of teeth 151 engaged by the pawl 140 allows the visor to retain the same uppermost position, irrespective of the position of the base plate 122 and cam 128. Thus, when the base plate is arranged as in FIG. 9 to allow the visor to take up its lowest possible position, the pawl 140, when the visor is in its upper position, will engage the highest serration 151. If the base plate 122 is rotated anticlockwise to its fullest extent, the pawl 140, when the visor is in the same uppermost position, will latch in the lowest serration 151. The other serrations 151 allow for intermediate positions of the base plate 122.

The inner visor 114 is prevented from rotating backwards beyond its uppermost position by engagement of the arm 118 with a profiled stop 158. The visor 114 is prevented from moving below its lowest position by engagement of the release lever 126 with the stop 158. The stop 158 is shaped to fit closely against the contour of the helmet shell and is smoothly contoured to reduce the possibility, for example, of being snagged by parachute risers.

The release lever 126 for the inner visor 114 carries two pins 160 and 162 which project towards the visor arm 118. The pin 160 is positioned so that, as the lever 126 is rotated in a clockwise direction from the upper position shown in FIG. 9, the pin 160 engages the pawl 140 so as to rotate it out of engagement with the serrations 151 of the cam plate 128. At the same time, the pin 160 engages the tooth 150 of the pawl 140 so that on further rotation of the lever 126 the pawl 140 and the arm 118 are rotated with the lever 126. The pin 162 is positioned so that, as the lever 126 is rotated in an anticlockwise direction from the lower position, the lug 162 engages the pawl 142 so as to rotate it out of engagement with the cam plate 128, and, on further rotation of the lever 126, to move the pawl 142 to rotate the arm 118. Stops 141 and 143 on the arm 118 limit the rotation of the pawls 140 and 142 by the pins 160 and 162.

Figure 8:
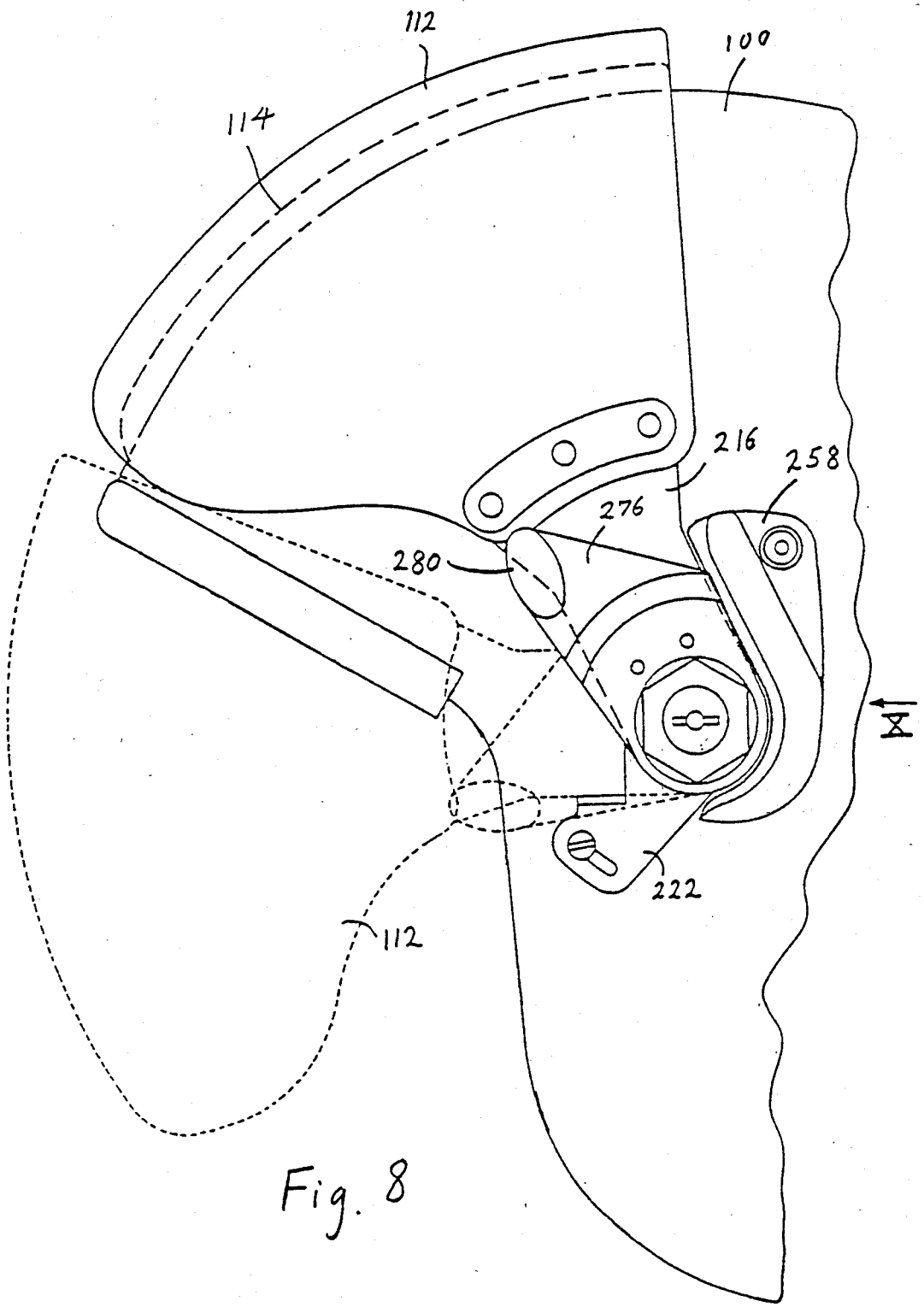
FIG. 8 is a left side view of part of an aircrew helmet with a twin visor assembly in accordance with a second embodiment of the invention.

The arms 216 and 218 on the left hand side of the helmet are similarly pivoted on a pillar fixed to a base plate 222 (FIG. 8). The base plate 222 can be rotated through a limited angle, in a similar manner to the base plate 122. Also pivoted on the pillar is a release lever 226 for the outer visor 112. Sandwiched between the arm 216 of the outer visor 112 and the release lever 226 is a cam plate 228 which is held against rotation relative to the base plate 222. Friction washers 231 and 233 fit between the base plate 222 and the visor arm 218 for the inner visor 114, and between the release lever 226 and a nut 234 retaining the components of the helmet. A spacer 235 fits between the arms 216 and 218.

The arm 216 for the outer visor 112 carries two pawls (not shown) arranged to engage respectively in a recess in the cam plate 228 to lock the visor 112 in the lower position, and in one of a series of serrations 251 in the cam plate 228 to lock the visor 112 in the upper position. The release lever 226 for the outer visor 112 carries two pins 260 and 262 arranged to engage the respective pawls, to move the pawls out of engagement with the cam plate and thereafter to rotate the arm 216 to move the visor 112 between the upper and lower positions. The mechanism is essentially identical to the mechanism employed to rotate the inner visor 114 and to lock it in upper and lower positions, and will therefore not be described further. The release lever 226 has an arm 276 ending in a knob 280, which can be grasped by the left hand of the wearer to move the outer visor 112. A visor stop 258 fixed to the left side of the helmet shell is shaped to engage the release lever 226 and the arm 216, to prevent rotation of the outer visor 112 beyond its upper and lowermost positions.

Figure 14:
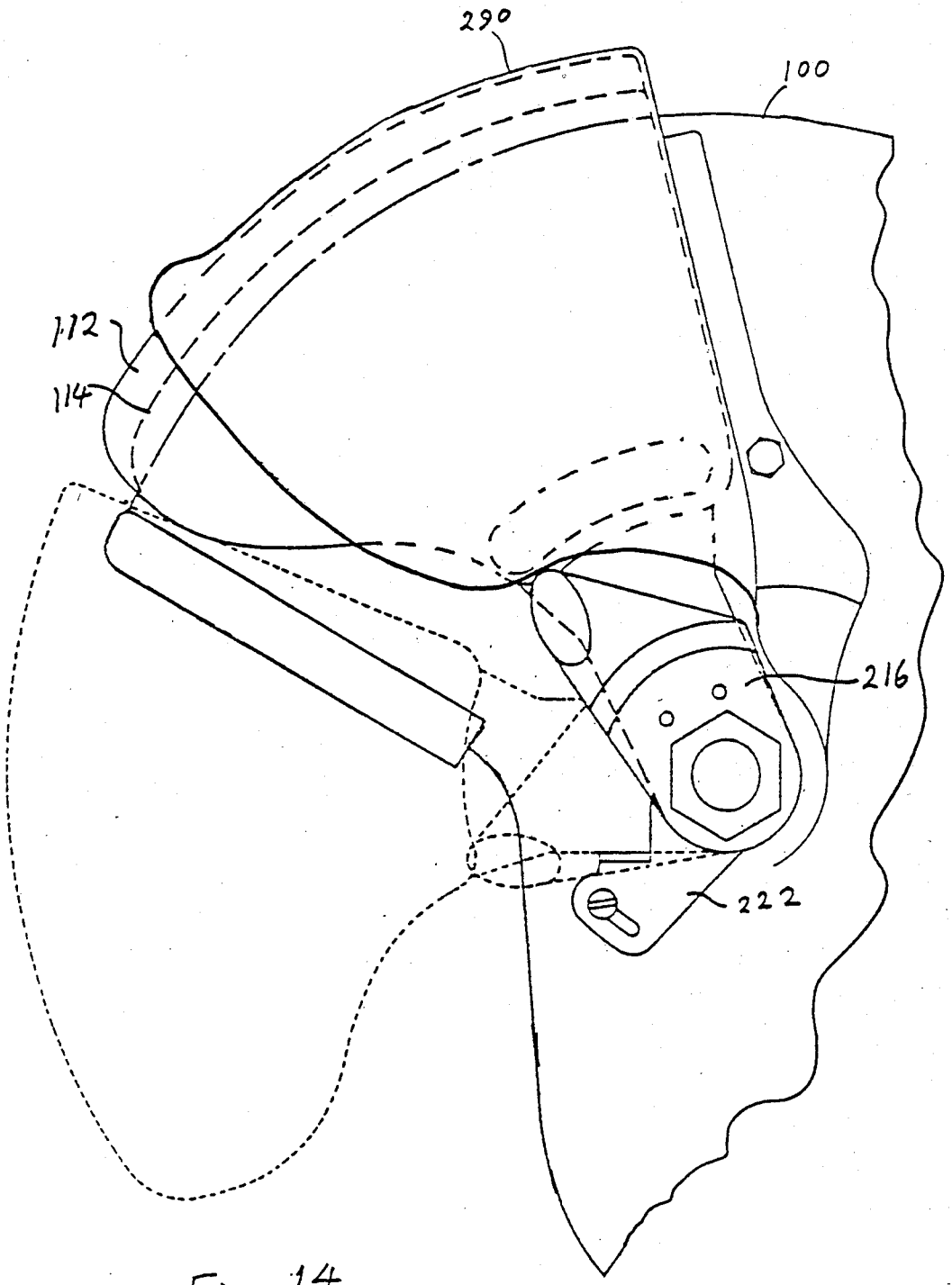

FIG. 14 shows a modification of the embodiment of FIGS. 8 to 13, in which the visor stops 158 and 258 are omitted. In this modification, rotation of the visors rearwardly beyond their upper positions is prevented by engagement of the visors in a rigid visor cover 290. The visor cover is fixed to the helmet shell and extends forwardly over the front part of the helmet shell to define a cavity in which the visors are received.

It will be appreciated that modifications could be made in the described embodiments. For example, in the first described embodiment, the locking mechanism and release levers could be provided on the right hand side of the helmet. The locking and release mechanisms of the embodiment of FIGS. 1 to 7 could be made similar to those of the embodiment of FIGS. 8 to 13. For example, the cam plates 28 and 30 could be similar to the cam plate 228, with the base plate 22 adjustable to accommodate different lower positions of the visors. The invention could also be applied to a helmet having only a single visor, for example by using on only one side of the helmet one of the release and locking mechanisms shown in the embodiment of FIGS. 8 to 13.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim

1. A helmet provided with a visor movable between a raised position and a lowered position, a releasable locking mechanism operable to lock the visor in the raised or the lowered position, and an operating lever positioned on the helmet for operation by the wearer using one hand and being movable between first and second positions, the lever being connected to the visor so that movement of the lever between its first and second positions moves the visor between its raised and lowered position, in which the locking mechanism comprises cooperating members connected to the helmet and the visor, respectively, the cooperating members being adapted to move into locking engagement with one another in response to movement of the visor to the raised or lowered position, thereby locking the visor in the raised or lowered position, and the operating lever is adapted to engage one of the cooperating members to move it out of locking engagement during an initial part of the movement of the lever from its first or its second position to allow the visor to be moved by the operating lever.

2. The helmet as claimed in claim 1, in which the helmet is provided with twin visors, movable independently between raised and lowered positions, and a separate operating lever and locking mechanism are provided for each visor.

3. The helmet as claimed in claim 2, in which the two operating levers are positioned on the same side of the helmet.

4. The helmet as claimed in claim 2, in which the two operating levers are positioned respectively on opposite sides of the helmet.

5. The helmet as claimed in claim 1, in which the cooperating members comprise a locking member fixed to the helmet and two pawls mounted on the visor, each pawl being resiliently biased to a position in which it engages the locking member to lock the visor in the raised or lowered position, respectively, the operating lever being arranged to engage the appropriate pawl and move it out of engagement with the locking member during the initial part of the movement of the lever.

6. The helmet as claimed in claim 5, in which the visor includes a supporting arm, the pawls of the locking mechanism are carried on the supporting arm, and the operating lever is arranged to remain in engagement with the appropriate pawl after moving it out of engagement with the locking member, the force acting on the lever being transmitted through the pawl to the supporting arm to move the supporting arm from one position to the other.

7. The helmet as claimed in claim 5, in which the locking member is arranged to provide two alternative lower positions in which the visor can be selectively locked.

8. The helmet as claimed in claim 7, in which the locking member has two recesses in which the pawl for locking the visor in its lower position can engage, the recesses being spaced apart to define the two lower positions of the visor.

9. The helmet as claimed in claim 7, in which the locking member has a single recess in which the pawl for locking the visor in its lower position can engage, and the locking member is rotatable on the helmet between two positions defining the two lower positions of the visor, the position of engagement with the locking member of the pawl for locking the visor in its upper position being variable to enable the visor to take up the same upper position irrespective of the position of the locking member relative to the helmet.

10. The helmet as claimed in claim 6, in which the operating lever and the supporting arm of the visor are pivotally mounted for rotation about a common axis.

* * * * *